US009794988B2

(12) United States Patent
Rigolle et al.

(10) Patent No.: US 9,794,988 B2
(45) Date of Patent: Oct. 17, 2017

(54) INDUCTION HOB WITH INDUCTION COILS AND AN APPARATUS FOR DETERMINING THE TEMPERATURES ON THE INDUCTION COILS

(75) Inventors: Thibaut Rigolle, Forli (IT); Jeanneteau Laurent, Forli (IT); Alex Viroli, Forli (IT); Filippo Martini, Forli (IT)

(73) Assignee: Electrolux Home Products Corporation N.V., Brussels (BE)

( * ) Notice: Subject to any disclaimer, the term of this patent is extended or adjusted under 35 U.S.C. 154(b) by 826 days.

(21) Appl. No.: 13/511,219

(22) PCT Filed: Dec. 20, 2010

(86) PCT No.: PCT/EP2010/007789
§ 371 (c)(1),
(2), (4) Date: May 22, 2012

(87) PCT Pub. No.: WO2011/072878
PCT Pub. Date: Jun. 23, 2011

(65) Prior Publication Data

US 2012/0241441 A1 Sep. 27, 2012

(30) Foreign Application Priority Data

Dec. 19, 2009 (EP) ..... 09015757

(51) Int. Cl.
*H05B 6/12* (2006.01)
*H05B 6/06* (2006.01)

(52) U.S. Cl.
CPC ..... *H05B 6/062* (2013.01); *H05B 2213/03* (2013.01); *H05B 2213/07* (2013.01)

(58) Field of Classification Search
CPC ..... H05B 2213/03; H05B 2213/04; H05B 2213/07; H05B 6/062
(Continued)

(56) References Cited

U.S. PATENT DOCUMENTS 6,498,325 B1 * 12/2002 Akel et al. ..... 219/624
7,361,870 B2 * 4/2008 Cornec et al. ..... 219/660
(Continued)

FOREIGN PATENT DOCUMENTS

EP 0412875 2/1991
EP 1404154 3/2004
(Continued)

OTHER PUBLICATIONS

International Search Report for PCT/EP2010/007789 dated Mar. 31, 2011, 2 pages.

*Primary Examiner* — Tu B Hoang
*Assistant Examiner* — Michael Hoang
(74) *Attorney, Agent, or Firm* — Pearne & Gordon LLP

(57) ABSTRACT

The present invention relates to an induction hob with a number of induction coils (12) on a cooking surface (10) and an apparatus for determining the temperatures on the induction coils (12). The induction coils (12) are arranged on the cooking surface (10) according to a predetermined scheme. At least one temperature sensor (14, 16, 18, 20; 24, 26) is arranged within an intermediate space between two or more induction coils (12). The at least one temperature sensor (14, 16, 18, 20; 24, 26) and the central portions of at least two adjacent induction coils (12) are thermally connected by heat conductor elements (22). The temperature sensors (14, 16, 18, 20; 24, 26) are electrically connected to at least one evaluation circuit for determining the temperatures of the adjacent induction coils (12).

14 Claims, 2 Drawing Sheets

(58) Field of Classification Search
USPC ..... 219/620–622, 624, 626–627, 647; 336/225
See application file for complete search history.

(56) References Cited

U.S. PATENT DOCUMENTS

| | | | | |
|---|---|---|---|---|
| 8,188,409 | B2 * | 5/2012 | Baier | 219/413 |
| 2006/0091135 | A1 * | 5/2006 | Kondo et al. | 219/621 |
| 2007/0262072 | A1 * | 11/2007 | Schilling | 219/451.1 |
| 2009/0212042 | A1 * | 8/2009 | Lee et al. | 219/624 |

FOREIGN PATENT DOCUMENTS

| | | | | |
|---|---|---|---|---|
| EP | 1575336 | | 9/2005 | |
| EP | 1575336 | A1 * | 9/2005 | H05B 6/12 |

* cited by examiner

INDUCTION HOB WITH INDUCTION COILS AND AN APPARATUS FOR DETERMINING THE TEMPERATURES ON THE INDUCTION COILS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND

Field of the Disclosure

The present invention relates to an induction hob with induction coils within a cooking surface and an apparatus for determining the temperatures on the induction coils. In particular, the induction hob is provided for household appliances.

Description of Related Art Including Information Disclosed Under 37 DFR 1.97 and 1.98

Induction hobs become an increasing meaning for cooking purposes, in particular for household appliances. The induction hobs comprise a number of induction coils arranged on a cooking surface. Each heating zone corresponds with one induction coil. In order to allow a control of the induction hob, several temperature sensors are provided on the cooking surface. Typically, a temperature sensor is arranged in the center of each induction coil.

Additionally, a piece of aluminum may be associated with the temperature sensor. Said piece of aluminum extends from the temperature sensor in the center of the induction coil to an outer position of the induction coil. The piece of aluminum acts as a heat conductor, so that the temperature at said outer position of the induction coil can be detected by the temperature sensor in the center of the induction coil.

A typical induction hob of the prior art requires a relative high number of temperature sensors, i.e. as the number of induction coils.

It is an object of the present invention to provide an induction hob with induction coils and an apparatus for determining the temperatures on the induction coils, which apparatus allows a reduced number of temperature sensors on said induction hob.

The object of the present invention is achieved by the induction hob according to claim 1.

BRIEF SUMMARY

According to the present invention the induction hob is provided with a number of induction coils on a cooking surface and an apparatus for determining the temperatures on the induction coils, wherein: the induction coils are arranged on the cooking surface according to predetermined scheme, at least one temperature sensor is arranged within an intermediate space between two or more induction coils, the at least one temperature sensor and the central portions of at least two adjacent induction coils are thermally connected by heat conductor elements, and the temperature sensors are, in particular electrically or by remote, connected to at least one evaluation circuit for determining the temperatures of the adjacent induction coils.

The main idea of the present invention is the arrangement of the temperature sensors within the intermediate space between the induction coils on the one hand and the connection of the temperature sensors with the induction coils by the heat conductor elements on the other hand, wherein the one evaluation circuit is provided for determining the temperatures of the adjacent induction coils of said temperature sensors. This structure allows a reduction of the number of the temperature sensors. The number of the corresponding electronic detection circuits and wires is also reduced.

According to a preferred embodiment of the present invention at least a part of the induction coils is arranged as a matrix on the cooking surface or at least on a section of the cooking surface.

Alternatively or additionally, at least a part of the induction coils may be arranged as a honeycomb on the cooking surface or at least on a section of the cooking surface.

In particular, the at least one evaluation circuit may take into account the adjacent temperature sensors of the induction coil in order to determine the temperature of said induction coil.

For example, at least one temperature sensor is arranged within at least one intermediate space between three induction coils, wherein said induction coils form a triangle on the cooking surface.

Alternatively or additionally, at least one temperature sensor may be arranged within at least one intermediate space between four induction coils, wherein said induction coils form a rectangle or a square on the cooking surface.

Preferably, at least one heat conductor element is formed as an elongated sheet. This guarantees a sufficient heat transfer from the induction coil to the temperature sensor.

According to the preferred embodiment of the present invention at least one heat conductor element is triangular, wherein the most acute angle of said triangular heat conductor element is thermally connected to the central portion of the induction coil.

Further, at least one temperature sensor may be arranged in central portion of the induction coil. In this case the at least one temperature sensor may be connected to an adjacent intermediate space between two or more induction coils by a further heat conductor element. Thereby, at least one further heat conductor element is an elongated triangular sheet, wherein the most acute angle of said triangular heat conductor element is thermally connected to the intermediate space between two or more induction coils.

Preferably, at least one heat conductor element is made of metal, in particular made of aluminum.

Novel and inventive features of the present invention are set forth in the appended claims.

BRIEF DESCRIPTION OF THE SEVERAL VIEWS OF THE DRAWINGS

The present invention will be described in further detail with reference to the drawings, in which.

DETAILED DESCRIPTION

Figure 1:
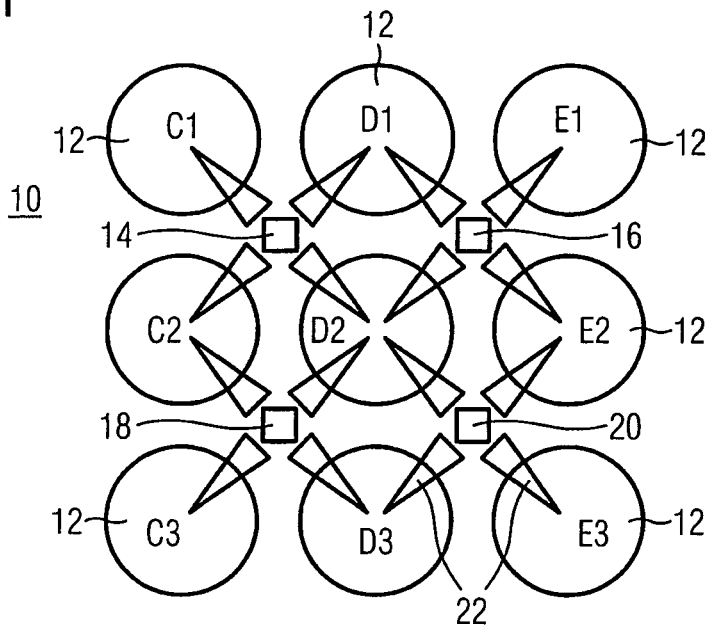
FIG. 1 illustrates a schematic top view of an arrangement of nine induction coils within a cooking surface of an induction hob according to a first embodiment of the present invention.

FIG. 1 illustrates a schematic top view of an arrangement of nine induction coils 12 within a cooking surface 10 of an induction hob according to a first embodiment of the present invention.

The nine induction coils 12 are arranged as a matrix with three lines and three columns. The nine induction coils 12 are denoted as C1, C2, C3, D1, D2, D3, E1, E2 and E3. The numbers 1, 2 and 3 represent the lines of said matrix. The columns of said matrix are represented by the letters C, D and E.

Temperature sensors 14, 16, 18 and 20 are arranged in central positions of intermediate spaces between four induction coils 12 in each case. A first temperature sensor 14 is in the central position of the intermediate space between the induction coils C1, D1, C2 and D2. A second temperature sensor 16 is in the central position of the intermediate space between the induction coils D1, E1, D2 and E2. A third temperature sensor 18 is in the central position of the intermediate space between the induction coils C2, D2, C3 and D3. A fourth temperature sensor 20 is in the central position of the intermediate space between the induction coils D2, E2, D3 and E3.

From the temperature sensors 14, 16, 18 and 20 four heat conductor elements 22 in each case extend to the centers of the neighboring induction coils 12. Four heat conductor elements 22 extend from the temperature sensor 14 to the centers of the induction coils C1, D1, C2 and D2. In a similar way, four heat conductor elements 22 extend from the temperature sensor 16 to the centers of the induction coils D1, E1, D2 and E2. Further, four heat conductor elements 22 extend from the temperature sensor 18 to the centers of the induction coils C2, D2, C3 and D3. At last, four heat conductor elements 22 extend from the temperature sensor 20 to the centers of the induction coils D2, E2, D3 and E3.

The heat conductor elements 22 are made of metal and formed as stripes. In this example, the heat conductor elements 22 are formed as elongated triangles, wherein the most acute angle of said triangle is arranged in the central portion the induction coils 12. For example, the heat conductor elements 22 are made of aluminum.

The four neighboring induction coils 12 of the temperature sensor 14, 16, 18 or 20 form a square or at least a rectangle.

The temperature sensors 14, 16, 18 and 20, the heat conductor elements 22 and evaluation circuit, which is not shown, form an apparatus for determining the temperatures on the induction coils.

The four temperature sensors 14, 16, 18 and 20 allow an approximate determination of the temperatures on each induction coil 12. The following table illustrates the relationship between the temperature sensors 14, 16, 18 and 20 and the induction coils C1, C2, C3, D1, D2, D3, E1, E2 and E3.

| | Temperature sensor | | | |
|---|---|---|---|---|
| Induction coil | 14 | 16 | 18 | 20 |
| C1 | X | | | |
| C2 | X | X | | |
| C3 | | X | | |
| D1 | X | | X | |
| D2 | X | X | X | X |
| D3 | | X | | X |
| E1 | | | X | |
| E2 | | | X | X |
| E3 | | | | X |

If the temperature of the induction coil D1 has to be determined, then the temperature sensors 14 and 16 are taken into account. However, the temperature sensors 14 and 16 will be affected by the temperatures of the adjacent induction coils 12. The temperature sensor 14 will additionally be affected by the induction coils C1, C2 and D2. In a similar way, the temperature sensor 16 will additionally be affected by the induction coils D2, E1 and E2. However, the evaluation circuit always takes the worst case into account.

Figure 2:
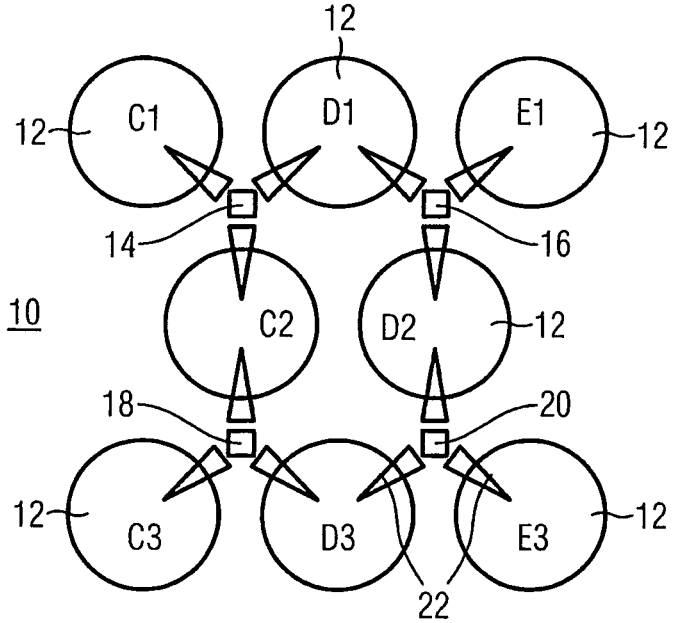
FIG. 2 illustrates a schematic top view of an arrangement of eight induction coils within the cooking surface of the induction hob according to a second embodiment of the present invention.

FIG. 2 illustrates a schematic top view of an arrangement of eight induction coils 12 within the cooking surface 10 of the induction hob according to a second embodiment of the present invention.

A first line and a third line include three induction coils 12 in each case. A second line includes two induction coils 12 arranged between intermediate spaces of the induction coils 12 of the first and third lines. Thus, the eight induction coils 12 of the second embodiment are arranged like a honeycomb.

The induction coils 12 of the first line are denoted as C1, D1 and E1. The induction coils 12 of the second line are denoted as C2 and D2. The induction coils 12 of the third line are denoted as C3, D3 and E3. Thus, the numbers represent the lines and the letters represent substantially the columns.

In central positions of the intermediate spaces between three induction coils 12 in each case the temperature sensors 14, 16, 18 and 20 are arranged. A first temperature sensor 14 is in the central position of the intermediate space between the induction coils C1, D1 and C2. A second temperature sensor 16 is in the central position of the intermediate space between the induction coils D1, E1 and D2. A third temperature sensor 18 is in the central position of the intermediate space between the induction coils C2, C3 and D3. A fourth temperature sensor 20 is in the central position of the intermediate space between the induction coils D2, D3 and E3.

The three neighboring induction coils 12 of the temperature sensor 14, 16, 18 or 20 form a triangle.

From the temperature sensors 14, 16, 18 and 20 three heat conductor elements 22 in each case extend to the centers of the neighboring induction coils 12. Three heat conductor elements 22 extend from the temperature sensor 14 to the centers of the induction coils C1, D1, C2 and D2. In a similar way, three heat conductor elements 22 extend from the temperature sensor 16 to the centers of the induction coils D1, E1 and D2. Further, three heat conductor elements 22 extend from the temperature sensor 18 to the centers of the induction coils C2, C3 and D3. At last, three heat conductor elements 22 extend from the temperature sensor 20 to the centers of the induction coils D2, D3 and E3.

The heat conductor elements 22 are of the same kind as in the first embodiment. The temperature sensors 14, 16, 18 and 20, the heat conductor elements 22 and the evaluation circuit, which is not shown, form the apparatus for determining the temperatures on the induction coils.

In this embodiment four temperature sensors 14, 16, 18 and 20 are sufficient for determining the temperatures on the eight induction coils 12. For example, in order to estimate the temperature on the induction coil D1, the evaluation circuit will take into account the temperature sensors 14 and 16.

Figure 3:
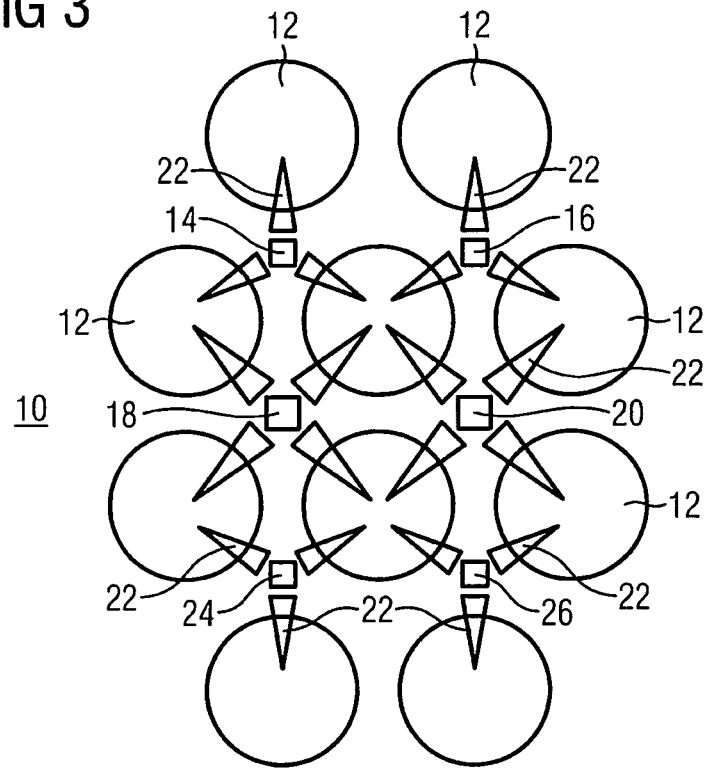
FIG. 3 illustrates a schematic top view of an arrangement of ten induction coils within the cooking surface of the induction hob according to a third embodiment of the present invention.

FIG. 3 illustrates a schematic top view of an arrangement of ten induction coils 12 within the cooking surface 10 of the induction hob according to a third embodiment of the present invention.

Two induction coils 12 are arranged in a first line, three induction coils 12 are arranged in a second line, also three induction coils 12 are arranged in a third line and again two induction coils 12 are arranged in a fourth line. The induction coils 12 of the second and the third line are arranged side-by-side. The induction coils 12 of the first line are arranged beside the intermediate spaces between the induction coils 12 of the second line. The induction coils 12 of the fourth line are arranged beside the intermediate spaces between the induction coils 12 of the third line.

Six temperature sensors 14, 16, 18, 20, 24 and 26 are arranged in the central positions of the intermediate spaces between three or four induction coils 12, respectively. The first temperature sensor 14 is in the central position of the intermediate space between three induction coils 12 forming a triangle. In a similar way, the second temperature sensor 16 is in the central position of the intermediate space between three induction coils 12 forming a triangle. The third temperature sensor 18 and the fourth temperature sensor 20 are in the central positions of the intermediate spaces between four induction coils 12 in each case, wherein said four induction coils 12 form a square. A fifth temperature sensor 24 and a sixth temperature sensor 26 are in the central positions of the intermediate spaces between three induction coils in each case, wherein said three induction coils 12 form a triangle.

From the temperature sensors 14, 16, 24 and 26 three heat conductor elements 22 in each case extend to the centers of the three neighboring induction coils 12, respectively. From the temperature sensors 18 and 20 four heat conductor elements 22 in each case extend to the centers of the four neighboring induction coils 12, respectively.

The heat conductor elements 22 are of the same kind as in the first and second embodiments. The temperature sensors 14, 16, 18, 20, 24 and 26, the heat conductor elements 22 and the evaluation circuit, which is not shown, form the apparatus for determining the temperatures on the induction coils. In this embodiment the six temperature sensors 14, 16, 18, 20, 24 and 26 are sufficient for determining the temperatures on the ten induction coils 12.

Figure 4:
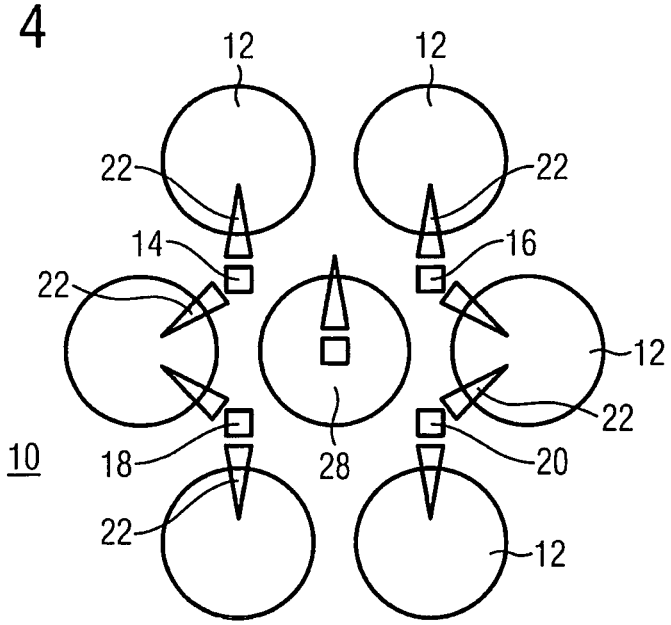
FIG. 4 illustrates a schematic top view of an arrangement of seven induction coils within the cooking surface of the induction hob according to a fourth embodiment of the present invention.

FIG. 4 illustrates a schematic top view of an arrangement of seven induction coils 12 within the cooking surface 10 of the induction hob according to a fourth embodiment of the present invention.

Two induction coils 12 are arranged in a first line, three induction coils 12 are arranged in a second line and two induction coils 12 again are arranged in a third line. The induction coils 12 of the first line are arranged beside the intermediate spaces between the induction coils of the second line. In a similar way, the induction coils 12 of the third line are arranged beside the intermediate spaces between the induction coils 12 of the second line. Thus, there are six outer induction coils 12 and one central induction coil 12 on the cooking surface 10.

The four temperature sensors 14, 16, 18 and 20 are arranged in the central positions of the intermediate spaces between three induction coils 12 in each case. A central temperature sensor 28 is arranged in the center of the central induction coil 12 of the cooking surface 10.

From the temperature sensors 14, 16, 18 and 20 two heat conductor elements 22 in each case extend to the centers of the two neighboring outer induction coils 12. From the central temperature sensor 28 one heat conductor element 22 extends to the intermediate space between the induction coils 12 of the first line and the central induction coil 12. In the last case the most acute angle of the heat conductor element 22 is arranged within the intermediate space between the induction coils 12 of the first line and the central induction coil 12.

Also these heat conductor elements 22 are of the same kind as in the above embodiments. The temperature sensors 14, 16, 18, 20 and 28, the heat conductor elements 22 and the evaluation circuit, which is not shown, form the apparatus for determining the temperatures on the induction coils. In this embodiment the five temperature sensors 14, 16, 18, 20 and 28 are sufficient for determining the temperatures on the seven induction coils 12.

There are many further constellations for the arrangement of the induction coils 12 and the temperature sensors 14, 16, 18, 20, 24, 26 and/or 28 according to the schemes of the above embodiments and/or combinations of said embodiments. The number of the induction coils 12 on the cooking surface 10 is not limited at the numbers of induction coils 12 in the above embodiments.

Although illustrative embodiments of the present invention have been described herein with reference to the accompanied drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 cooking surface
12 induction coil
14 first temperature sensor
16 second temperature sensor
18 third temperature sensor
20 fourth temperature sensor
22 heat conductor element
24 fifth temperature sensor
26 sixth temperature sensor
28 central temperature sensor
C1 number of an induction coil
C2 number of an induction coil
C3 number of an induction coil
D1 number of an induction coil
D2 number of an induction coil
D3 number of an induction coil E1 number of an induction coil
E2 number of an induction coil
E3 number of an induction coil

The invention claimed is:

1. An induction hob with a number of induction coils (12) on a cooking surface (10) and an apparatus for determining temperatures on the induction coils (12), wherein:

the induction coils (12) are arranged on the cooking surface (10) according to a predetermined scheme, at least one temperature sensor (14, 16, 18, 20; 24, 26) is arranged within an intermediate space between two or more of the induction coils (12), at least one further temperature sensor (14, 16, 18, 20; 24, 26) is arranged within at least one further intermediate space between two or more of the induction coils (12), the at least one temperature sensor (14, 16, 18, 20; 24, 26) and the central portions of at least two adjacent coils of the induction coils (12) are thermally connected by heat conductor elements (22), and the at least one temperature sensor (14, 16, 18, 20; 24, 26) is connected to at least one evaluation circuit for determining the temperatures of the at least two adjacent induction coils (12).

2. The induction hob according to claim 1, characterized in, that at least a part of the induction coils (12) is arranged as a matrix on the cooking surface (10) or at least on a section of the cooking surface (10).

3. The induction hob according to claim 1, characterized in, that at least a part of the induction coils (12) is arranged as a honeycomb on the cooking surface (10) or at least on a section of the cooking surface (10).

4. The induction hob according to claim 1, characterized in, that the at least one evaluation circuit takes into account two of the at least one temperature sensor (14, 16, 18, 20; 24, 26) of the at least two adjacent coils of the induction coils (12) in order to determine the temperature of one of the induction coils (12).

5. The induction hob according to claim 1, characterized in that at least one temperature sensor (14, 16, 18, 20; 24, 26) is arranged within at least one intermediate space between three of the induction coils (12), wherein said three induction coils (12) form a triangle on the cooking surface (10).

6. The induction hob according to claim 1, characterized in, that at least one temperature sensor (14, 16, 18, 20; 24, 26) is arranged within at least one intermediate space between four of the induction coils (12), wherein said four induction coils (12) form a rectangle or a square on the cooking surface (10).

7. The induction hob according to claim 1, characterized in, that at least one of the heat conductor elements (22) is formed as an elongated sheet.

8. The induction hob according to claim 7, characterized in that at least one of the heat conductor elements (22) is triangular, wherein the most acute angle of said triangular heat conductor element (22) is thermally connected to the central portion of the induction coils (12).

9. The induction hob according to claim 1, characterized in, that at least one temperature sensor (28) is arranged in a central portion of one of the induction coils (12).

10. The induction hob according to claim 9, characterized in, that the at least one temperature sensor (28) arranged in the central portion of one of the induction coils is connected to an adjacent intermediate space between two or more of the induction coils (12) by a further heat conductor element (22).

11. The induction hob according to claim 10, characterized in, that the further heat conductor element (22) is an elongated triangular sheet, wherein the most acute angle of said triangular heat conductor element (22) is thermally connected to the adjacent intermediate space.

12. The induction hob according to claim 1, characterized in, that at least one of the heat conductor elements (22) is made of metal, in particular made of aluminum.

13. The induction hob according to claim 1, wherein at least one of the heat conductor elements is made of metal and is formed as a stripe.

14. An induction hob, the induction hob including:

a cooking surface;

a number of induction coils, the induction coils are arranged on the cooking surface according to a predetermined scheme;

an apparatus for determining temperatures on the induction coils;

at least one temperature sensor, the at least one temperature sensor is arranged within an intermediate space between two or more of the induction coils, wherein another of the at least one temperature sensor is arranged in a central portion of one of the induction coils;

at least one further temperature sensor, the at least one further temperature sensor is arranged within at least one further intermediate space between two or more of the induction coils;

a number of heat conductor elements, the heat conductor elements thermally connect the at least one temperature sensor and the central portions of at least two adjacent coils of the induction coils, wherein at least one of the heat conductor elements is made of aluminum;

a further heat conductor element, the further heat conductor element connects the another of the at least one temperature sensor to an adjacent intermediate space between two or more of the induction coils; and at least one evaluation circuit, the at least one evaluation circuit is connected to the at least one temperature sensor for determining the temperatures of at least two adjacent induction coils, wherein the at least one evaluation circuit takes into account two of the at least one temperature sensor of the induction coils, wherein two of the at least one temperature sensor are adjacent to one another in order to determine the temperature of one of the induction coils.

* * * * *